US010383452B2

(12) United States Patent
Nomura et al.

(10) Patent No.: US 10,383,452 B2
(45) Date of Patent: Aug. 20, 2019

(54) BOTTOM FOR BED APPARATUS

(71) Applicant: PARAMOUNT BED CO., LTD., Tokyo (JP)

(72) Inventors: Katsuyoshi Nomura, Tokyo (JP); Takeshi Yanagihara, Tokyo (JP); Yuji Nakano, Tokyo (JP); Takaki Matsumoto, Tokyo (JP); Tatsuya Shimada, Tokyo (JP); Dan Kageyama, Tokyo (JP); Eita Hirai, Tokyo (JP); Shinnosuke Kubota, Tokyo (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 0 days.

(21) Appl. No.: 15/942,460

(22) Filed: Mar. 31, 2018

(65) Prior Publication Data

US 2018/0220804 A1 Aug. 9, 2018

Related U.S. Application Data

(63) Continuation of application No. 14/782,444, filed as application No. PCT/JP2014/057564 on Mar. 19, 2014, now abandoned.

(30) Foreign Application Priority Data

Apr. 18, 2013 (JP) ..... 2013-087376

(51) Int. Cl.
*A47C 20/04* (2006.01)
*A61G 7/015* (2006.01)
(Continued)

(52) U.S. Cl.
CPC ..... *A47C 20/04* (2013.01); *A47C 20/08* (2013.01); *A61G 7/002* (2013.01); *A61G 7/015* (2013.01)

(58) Field of Classification Search
CPC ..... A47C 20/027; A47C 20/04; A47C 20/08; A47C 19/025; A47C 19/04; A61G 7/00; A61G 7/002; A61G 7/005; A61G 7/015
See application file for complete search history.

(56) References Cited

U.S. PATENT DOCUMENTS 3,717,376 A * 2/1973 Lutchansky ..... A47C 31/123 297/284.1
4,785,487 A * 11/1988 Toran ..... A47C 19/045 5/613

(Continued)

FOREIGN PATENT DOCUMENTS

CN 1380826 A 11/2002
GB 2 362 566 A 11/2001

(Continued)

OTHER PUBLICATIONS

International Search Report for corresponding International Application No. PCT/JP2014/057564 dated May 13, 2014.

(Continued)

*Primary Examiner* — Robert G Santos
*Assistant Examiner* — David R Hare
(74) *Attorney, Agent, or Firm* — Renner, Otto, Boisselle & Sklar, LLP

(57) ABSTRACT

To provide a bottom for a bed apparatus that can relieve the sensation of being pressed and that at the same time is lightweight, easy to transport and can be cleaned easily. A bottom for a bed apparatus having a back-raising mechanism, includes a flexing bottom that is arranged between a back bottom and a hip bottom and can be flexed. In a back-raising operation, the flexing bottom flexes between the back bottom and the hip bottom while sliding downward over the surface of the uprising back bottom.

9 Claims, 10 Drawing Sheets

(51) Int. Cl.
*A47C 20/08* (2006.01)
*A61G 7/002* (2006.01)

(56) References Cited

U.S. PATENT DOCUMENTS

| | | | | |
|---|---|---|---|---|
| 5,222,263 | A * | 6/1993 | Magistretti | A47C 7/38 297/29 |
| 5,377,369 | A * | 1/1995 | Shirai | A47C 20/04 5/188 |
| 5,388,290 | A * | 2/1995 | Shirai | A47C 20/04 5/188 |
| 5,469,591 | A * | 11/1995 | Nomura | A47C 20/04 5/191 |
| 6,389,622 | B1 * | 5/2002 | Her | A61G 7/002 5/425 |
| 6,647,569 | B1 * | 11/2003 | Tansek | A41D 31/005 2/413 |
| 6,957,460 | B2 * | 10/2005 | Horitani | A61G 7/015 5/618 |
| 7,036,166 | B2 | 5/2006 | Kramer et al. | |
| 7,058,999 | B2 * | 6/2006 | Horitani | A47C 20/041 5/616 |
| 7,325,265 | B2 * | 2/2008 | Hornbach | A61G 7/015 5/617 |
| 7,346,946 | B2 * | 3/2008 | Takeuchi | A47C 20/04 5/186.1 |
| 7,610,638 | B2 | 11/2009 | Kramer et al. | |
| 8,146,190 | B1 * | 4/2012 | Wolfe | A47C 20/027 5/53.2 |
| 8,418,291 | B2 * | 4/2013 | Hornbach | A61G 7/002 5/600 |
| 9,635,949 | B2 * | 5/2017 | Nomura | A61G 7/015 |
| 9,907,714 | B2 * | 3/2018 | Malvestio | A61G 7/015 |
| 2002/0174487 | A1 | 11/2002 | Kramer et al. | |
| 2002/0178502 | A1 * | 12/2002 | Beasley | A61G 7/015 5/618 |
| 2005/0039263 | A1 * | 2/2005 | Reed | A47C 1/03211 5/618 |
| 2006/0117479 | A1 * | 6/2006 | Kawakami | A61G 7/008 5/411 |
| 2006/0143829 | A1 * | 7/2006 | Kramer | A61G 7/015 5/618 |

FOREIGN PATENT DOCUMENTS

| | | | |
|---|---|---|---|
| JP | 08-001059 | U | 7/1996 |
| JP | 11-089886 | A | 4/1999 |
| JP | 2005-087652 | A | 4/2005 |
| JP | 2005-509450 | A | 4/2005 |
| JP | 2006-136635 | A | 6/2006 |
| WO | WO 2012/086907 | A2 | 6/2012 |

OTHER PUBLICATIONS

International Preliminary Report on Patentability for corresponding International Application No. PCT/JP2014/057564 dated Oct. 20, 2015.

Extended European Search Report dated Oct. 19, 2016 for corresponding European Application No. 14784952.5.

Chinese Office Action dated Apr. 14, 2017 for corresponding Chinese Application No. 201480021917.8.

Office Action dated Aug. 2, 2017 for parent U.S. Appl. No. 14/782,444.

Office Action dated Jan. 4, 2018 for parent U.S. Appl. No. 14/782,444.

* cited by examiner (a)

(b)

BOTTOM FOR BED APPARATUS

TECHNICAL FIELD

The present invention relates to a bottom for a bed apparatus having a flexing portion arranged from the position below the back to the position below the hips so as to create a suitable curvature when a height-adjusting operation such as back-raising and the like is carried out.

BACKGROUND ART

The bed that enables height-adjusting operations such as back-raising and leg-raising is basically configured such that the bottom is divided into a plurality of sections, e.g., a back bottom, a hip bottom, a leg bottom and a foot bottom to make these sections capable of flexing by joining one section to another in a mutually flexing manner, or by pivotally supporting part of the sections on the frame that supports the bottom.

However, if, for example, the back bottom and the hip bottom are merely configured so as to rotate on their pivots to realize a flexed profile, the mattress rested on the bottom is compressed by the back bottom and hip bottom. As a result, there has been a problem that the bed user such as a patient or the like lying in the supine position feels pressure or other discomfort around the belly. In order to eliminate problems of this kind, measures have been conventionally considered.

The applicant of the invention hereof also has proposed various bottom structures that enable the flexing portion between the back bottom and the hip bottom to curve with a suitable curvature and fit to the flexed posture of the user's body. Japanese Patent Application Laid-open H11-89886 is one example of the proposals of the applicant hereof.

FIG. 9 is an external perspective view showing one example of a bed having such a flexing bottom. FIG. 10 is an external perspective view showing a flexing bottom used in this bed. As shown in FIG. 9, a flexing bottom 102 in a bed 100 is arranged between a back bottom 101 and a hip bottom 103. The flexing bottom 102 is coupled at one end with the back bottom 101 and at the other end with the hip bottom 103. As shown in FIG. 10, the flexing bottom 102 is comprised of a plurality of strip-like members 113 connected in series, each member can create an appropriate angle of flexure with adjacent member to form a suitable curving shape as a whole.

In the flexing bottom 102, each strip-like member 113 is formed with a plurality of stopper pieces 114 each having a hook-shaped part and a plurality of guide pieces 115 arranged appropriately apart from, and in parallel with, the stopper piece 114, across the one longitudinal side of the strip-like member 113. Further, on the opposite longitudinal side of the strip-like member 113, indentations for receiving the stopper pieces 114 and guide pieces 115 of the adjacent strip-like member 113 to be coupled are formed. These indentations are configured so that the size of the indentation is slightly greater than that of stopper piece 114 and guide piece 115. Further, at either end face of the strip-like member 113 in the bed width direction, a tongue 118 is integrally and protectively formed in parallel with the stopper piece 114 that is located near the end face. This tongue 118 is to prevent fingers and other objects from entering the space between neighboring strip-like members 113 from the end face side of the strip-like member 113 in the bed width direction. The tongues 118 are configured so that the tongue 118 of one strip-like member 113 receives at its proximal end the thrust from the distal end of the tongue 118 of the adjacent strip-like member 113 when the latter or adjacent strip-like member 113 sinks its stopper pieces 114 and guide pieces 115 into the indentations of the former strip-like member 113.

When a height-adjusting operation is performed in abed 100 (see FIG. 9) to which the above-described flexing bottom 102 is applied, the strip-like members 113 can shift little by little from each other to curve the flexing bottom 102 located from the position below the back to the position below the hips, in a downward convex form with an appropriate curvature over the entire flexing bottom 102, as shown in FIG. 10.

PRIOR ART DOCUMENTS

Patent Document

Patent Document 1:
Japanese Patent Application Laid-open H11-89886

SUMMARY OF THE INVENTION

Problems to be Solved by the Invention

However, since the aforementioned flexing bottom 102 is coupled at its ends to the back bottom 101 and the hip bottom 103 so that the back bottom 101 expands or contracts as it is flexing when the back bottom 101 is moved up or down, the structure of the flexing bottom is extremely complicated and will have some degree of weight and thickness, presenting poor transportability. Further, since the extensible structure including stopper pieces 114 and guide pieces 115 is complicated, it is hard to say that the structure is easy to clean by ordinary people.

In particular, the nursing home bed is often used as a rental bed, hence it is an important factor that the bed can be carried into, or out of, ordinary home. It is also important that an ordinary user can easily clean the bed without the need of decomposing and other labors.

Under the above circumstances, it is an object of the present invention to provide a bottom for a bed apparatus that relieves the sensation of being pressed or uncomfortable feeling when a height-adjusting operation such as back-raising is carried out and that at the same time is lightweight, easy to transport and can be cleaned easily.

Means for Solving the Problems

The present invention resides in a bottom for a bed apparatus having a back-raising mechanism, comprising a flexing bottom that can be flexed between a back bottom for supporting the back and a hip bottom for supporting the hips, wherein the flexing bottom is arranged slidably over the surface of the back bottom, joined and fixed to the hip bottom, and in a case of a back-raising operation, the flexing bottom flexes between the back bottom and the hip bottom while sliding downward over the surface of the uprising back bottom.

In the bottom for a bed apparatus of the present invention, a pair of a slot elongated in the sliding direction and a pin that moves being fitted therein, or plural pairs of the slots and pins, are provided in the corresponding positions of the back bottom and the flexing bottom, respectively, or vice versa.

In the bottom for a bed apparatus of the present invention, the back bottom is formed with a hollow that accommodates the flexing bottom and allows the flexing bottom to slide therein.

In the bottom for a bed apparatus of the present invention, the flexing bottom is constructed so as to be flexible by arranging a plurality of elongated bars each having a trapezoidal section and extended in the width direction, in the length direction and joining one to another with a thin part, forming an approximately bellows-like structure.

The bottom for a bed apparatus of the present invention further includes a knee bottom for supporting the knees and a foot bottom for supporting the feet, wherein the hip bottom, the knee bottom and the foot bottom have the same flexing structure as the flexing bottom.

Effect of the Invention

According to the present invention, since the bottom for a bed apparatus can be simply configured of a structure that itself is not expandable, it is possible to realize a lightweight configuration and improve transportability compared to the conventional configuration. Besides, ordinary people can easily perform cleaning without the need of decomposing and other labors.

MODE FOR CARRYING OUT THE INVENTION

Now, an embodiment of the present invention will be described with reference to the accompanying drawings.

Figure 1:
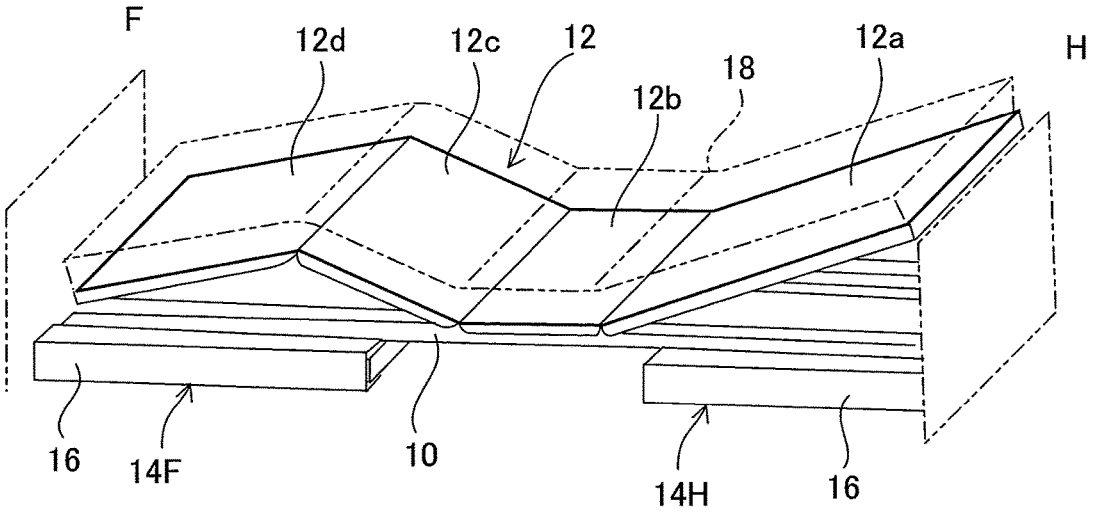
FIG. 1 (*a*) A schematic perspective view of a bed apparatus on which a bottom according to an embodiment of the present invention is mounted, and (b) a perspective view of the bottom.
Figure 1:
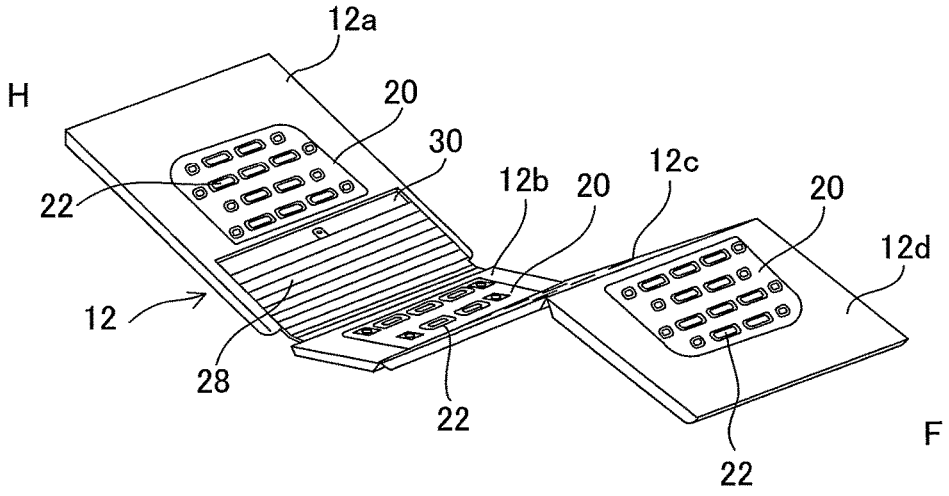

FIG. 1(*a*) is an overall perspective view of a bed apparatus on which a bottom according to the present invention is mounted, (b) is a perspective view of the bottom, and FIGS. 2 to 5 are illustrative views of the bottom.

Figure 2:
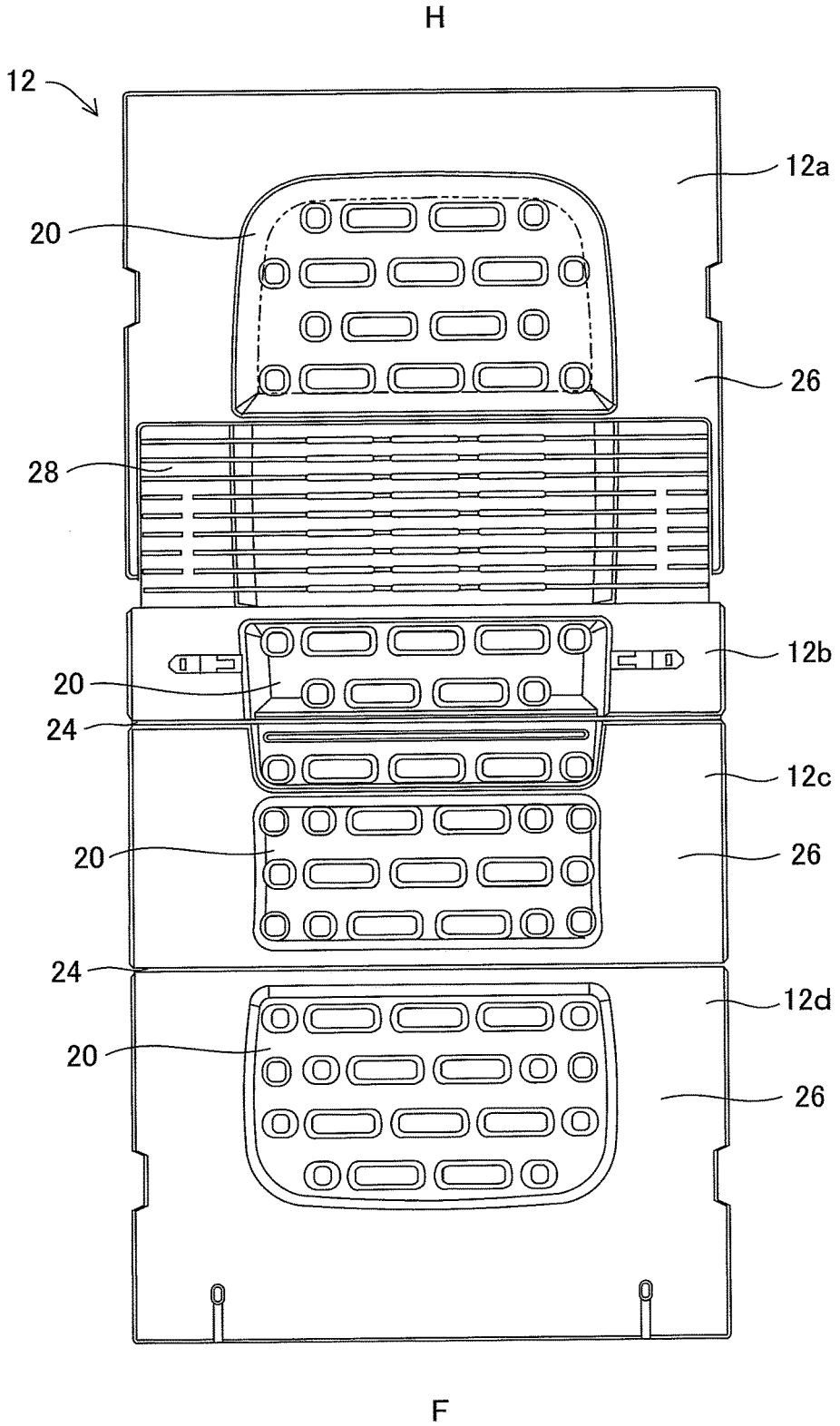
FIG. 2 An overall plan view of a bottom.

As shown in FIGS. 1 and 2, in the bed apparatus, the head side to which the head of the user is oriented when lying is indicated by "H" and the foot side to which the user's feet are oriented is indicated by "F".

As shown in FIG. 1(*a*), the bed apparatus includes: a top frame 10 having an approximate ladder structure with its length oriented along the direction from the head side to the foot side; a bottom 12 placed on the top frame 10; and a head-side lift 14H and a foot-side lift 14F that are arranged on the head and foot sides under the top frame 10, respectively, to support the top frame 10 so as to be raised and lowered relative to the floor.

Approximately rectangular support frames 16, longer in the width direction of the bed apparatus, on which the top frame 10 is set, are arranged on the head and foot sides under the top frame 10, and fixed to the top ends of the head-side lift 14H and foot-side lift 14F, respectively.

Though not illustrated, the lifts 14H and 14F are detachably joined at their lower ends by means of a connecting frame. Each of the lifts 14H and 14F is provided with an actuator so that the drive force of each actuator can be controlled separately. The top frame 10 is hence possible to perform a tilting operation for make level difference between the head side and the foot side by controlling drive of each actuator.

Further, in the top frame 10, a back-raising rod and a knee-raising rod are provided on the head side and in the center area, respectively. Actuators for driving these are also provided.

As shown in FIGS. 1 and 2, the bottom 12 supports the weight of the user with a mattress (schematically shown by a reference numeral '18' in FIG. 1) placed thereon. The bottom 12 is composed of multiple plates, specifically, a back bottom 12*a* for supporting the head and back of the user, a hip bottom 12*b* for supporting the hips, a knee bottom 12*c* for supporting part from hips to knees and a foot bottom 12*d* for supporting part from knees to toes.

In the top frame 10 of the bed apparatus of the embodiment, the bottom 12 arranged on the top frame 10 is height adjustable. That is, the back bottom 12*a* of the bottom 12 is configured to enable back-raising operation by means of the back-raising rod, and the knee bottom 12*c* and foot bottom 12*d* are configured to enable knee-raising operation and foot-raising operation by means of the knee-raising rod.

Herein, in the bottom 12, each of the back bottom 12*a*, hip bottom 12*b*, knee bottom 12*c* and foot bottom 12*d*, is formed of a resin plate having a thickness and formed with a depressed portion 20 on the top surface of each, as will be described in detail.

In the depressed portion 20, a plurality of passage holes 22 are perforated from the top surface to the undersurface of bottom 12. These multiple passage holes 22 are arrayed in the width and length directions of the bottom 12. The passage holes 22 may be provided in any form and in any number as appropriate. In the embodiment the passage holes 22 are formed such that a plurality of circular and rectangular (the long side oriented in the width direction) holes are arrayed in line and these lines are arranged in parallel in the longitudinal direction of the bottom 12, as shown in FIG. 2.

The depressed portions 20 are hollowed on the top surface of the bottom 12. The depressed portions 20 are formed in the central part of the bottom 12 with respect to the width direction. Specifically, in the bottom 12, depressed portions 20 are formed contiguously in the back bottom 12*a*, hip bottom 12*b*, knee bottom 12*c* and foot bottom 12*d*. The depressed portions 20 are formed on the top surface of bottom 12, leaving surrounding part of the bottom 12 as a whole.

That is, the depressed portions 20 are formed leaving flat surrounding areas 26 in the head side end of the back bottom 12*a*, both sides of the back bottom 12*a*, hip bottom 12*b*, knee bottom 12*c* and foot bottom 12*d* and the foot side end of the foot bottom 12*d*. In other words, the depressed portions 20 are formed in the interior part surrounded by the flat surrounding areas 26. The depressed portions 20 are suitably formed with a width ranging from one half to four fifths of the width of the bottom 12 though the bottom width can be determined as appropriate.

Figure 4:
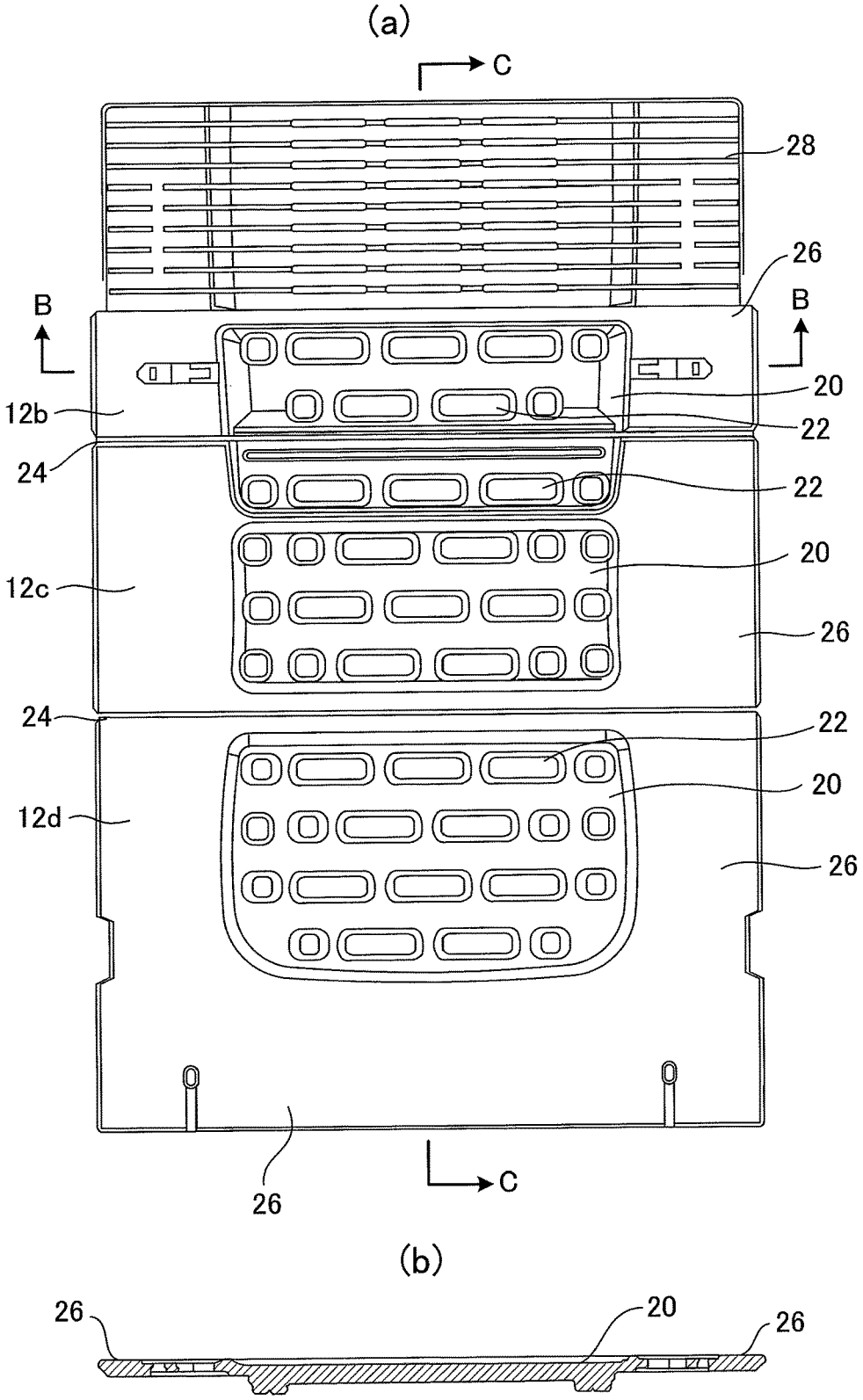
FIG. 4 (*a*) A plan view of essential parts of a bottom, or a hips bottom, a knee bottom and a leg bottom integrated, (b) a sectional view cut along a line B-B in (a).

As sectionally shown in FIGS. 4(*b*) and 5, the depressed portions 20 are formed with depths equal to or smaller than half the thickness of the thick portions such as surrounding areas 26 of the back bottom 12*a*, hip bottom 12*b*, knee bottom 12*c* and foot bottom 12*d* of the bottom 12. The periphery of the depressed portion 20 contiguous from the surrounding area 26 is gently beveled with an angle of about 30 to 50 degrees with respect to the flat surface so that the user will not feel a bumpy sensation in lying in bed.

According to the bottom 12 of the bed apparatus of the embodiment, the depressed portions 20 are formed around the center in the width direction of the bottom 12, so that the pressure against the body at points of contact when the user lies on the bed apparatus is alleviated compared to the case of a flat surface. In addition, the bottom can be made breathable thanks to the passage holes 22, the user feels comfortable when lying. Since the mattress on the bottom 12 sinks into the depressed portions 20, the mattress is unlikely to slip relative to the bottom 12, hence can be prevented from slipping.

Figure 3:
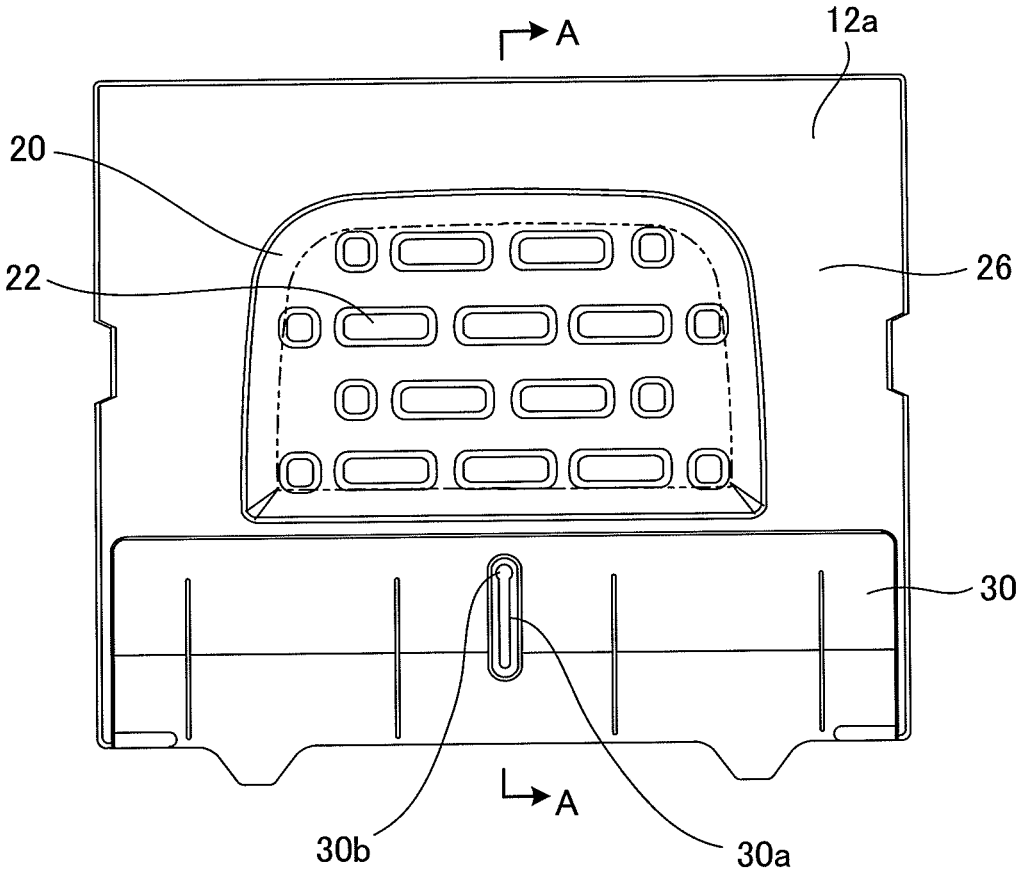
FIG. 3 A plan view of a back bottom of a bottom.

Herein, the back bottom 12*a* is formed as a single assembly as shown in FIG. 3. The back bottom 12*a* is fixed to the back-raising rod pivotable on the top frame 10 so as to enable a back-raising operation. Formed on the surface of the back bottom 12*a* is a coupling hollow 30 in which the entire flexing bottom 28 can be accommodated from the hip bottom side end. A passage slot 30*a* elongated in the length direction of the bottom (the sliding direction of the flexing bottom 28) is formed in the center of the coupling hollow 30 across the bottom width. Since an aftermentioned pin with a flange moves along this slot 30*a*, a flange insert hole 30*b* is formed at the end of the slot 30*a* in the bottom center.

As shown in FIG. 4, among all the parts, the hip bottom 12*b*, knee bottom 12*c* and foot bottom 12*d* are essential parts, which are joined by connecting parts 24, forming a single integrated assembly. The connecting parts 24 are formed of the same material with, thinner than, and integrally with, the essential parts, and arranged between the hip bottom 12*b* and the knee bottom 12*c* and between the knee bottom 12*c* and the foot bottom 12*d*. The integrated assembly of the hip bottom 12*b*, knee bottom 12*c* and foot bottom 12*d* are positioned and fixed to the top frame 10. For example, positioning parts are provided on the undersurface of the hip bottom 12*b*, so that the hip bottom is positioned to the steady frame thereby and fixed by pins and the like. Since the knee bottom 12 and foot bottom 12*d* are involved in knee-raising and foot-raising operations, these parts are not fixed to the top frame 10.

It should be noted that fixing positions are not limited to the hip bottom 12*b* but any part can be fixed to the top frame 10 as long as the height-adjusting operations of the bottom are not hindered.

A flexing bottom 28 is extended on the head side from the hip bottom 12*b* forming the aforementioned essential part, and the flexing bottom 28 flexibly joined to the back bottom 12*a* so as to slide along the back bottom 12*a*.

Figure 5:
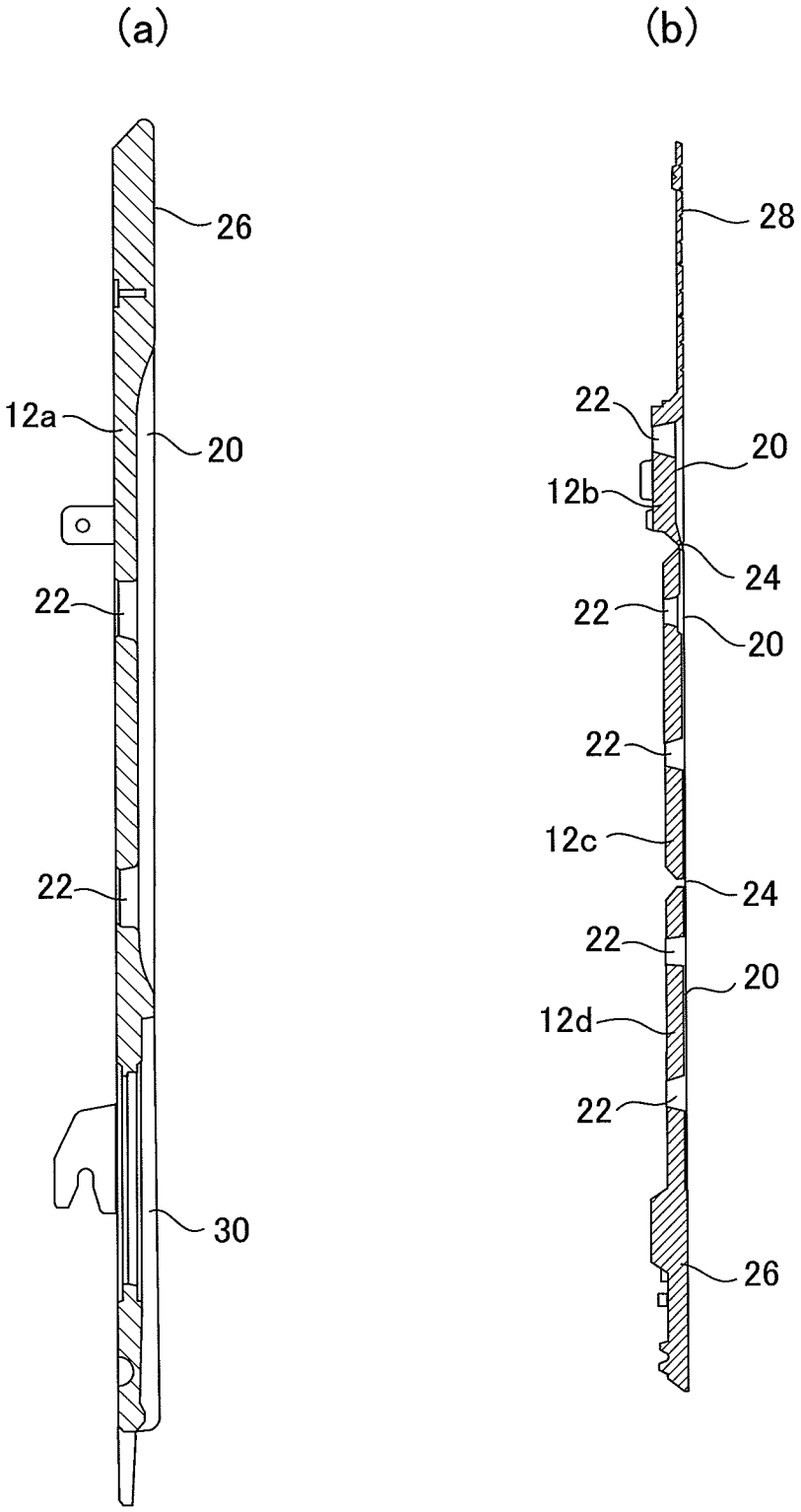
FIG. 5 (*a*) A sectional view cut along a line A-A in FIG. 3, and (b) a sectional view of foot-side parts, cut along a line C-C in FIG. 4(*a*).
Figure 6:
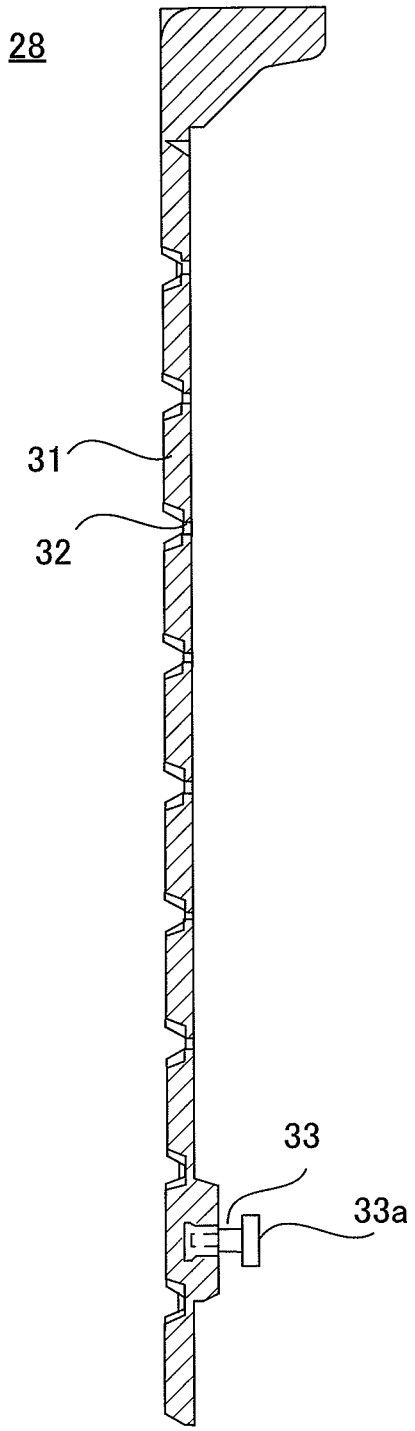
FIG. 6 A sectional view of a flexing bottom.

As shown in FIGS. 4 to 6, in this flexing bottom 28, a plurality of elongated bars 31 each having a trapezoidal section and extended in the width direction of bottom 12, are arranged in the length direction of the bottom 12 and joined to each other by a thin part 32, forming an approximately slatted board-like or bellows-like structure. The flexing bottom 28 is configured to be flexed at the thin parts 32, realizing a flexible structure. The thickness of the flexing bottom 28 is formed to be thinner than the other bottoms, or as thick as half the thickness of the other bottoms or below, as shown in FIG. 5(*b*). When this flexing bottom 28 is arranged so as to be accommodated in the coupling hollow 30 of the back bottom 12*a*, the flexing bottom 28 will not project so much beyond the surface of the back bottom 12*a* and can move smoothly in being slid over the coupling hollow 30.

The flanged pin 33 is attached on the underside of the flexing bottom 28 at a position close to the back bottom 12*a*. While the flange 33*a* of the pin 33 is inserted through the flange insert hole 30*b* in the back bottom 12*a*, the flexing bottom 28 is set in the coupling hollow 30 of the back bottom 12*a*. When the back bottom 12*a* is tilted up or down, the flexing bottom 28 moves within the coupling hollow 30 of the back bottom 12*a*, sliding in the length direction of the bottom 12. At this time, the pin 33 moves along the slots 30*a* while the flange 33*a* of the pin 33 slides on the underside of the back bottom 12*a*. In this way, the flexing bottom 28 will be able to slide being coupled with, without separating from, coupling hollow 30 of the back bottom 12*a* (see FIG. 3).

One set of pin 33 and its corresponding slot 30*a* may be provided, or plural sets of pins and slots may be provided. It is possible to provide the pin in the back bottom 12*a* while forming the slot in the flexing bottom 28. No flange is necessarily formed. A different structure other than the pin and slot may be provided for the back bottom 12*a* and flexing bottom 28. If it works, no slider joint mechanism of this kind is needed.

Figure 7:
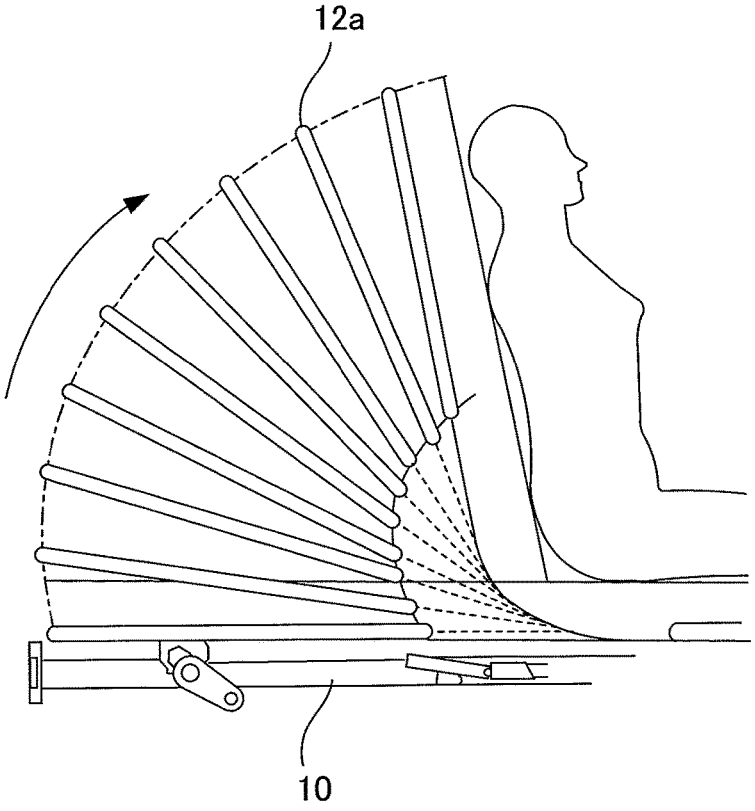
FIG. 7 An illustrative view showing a back-raising operation of a back bottom.

FIG. 7 shows a case where a back-raising operation is performed in this bed. When the back bottom 12*a* is tilted up by means of the back-raising rod, in general the back bottom 12*a* does not rotate about a single pivot, but rises up while rotating and shifting rearwards of the user (shifting leftwards in the drawing). This is a motion that is devised to relieve the user's feeling of being pressed and uncomfortable sensation when a back-raising operation is performed. Examples of mechanisms for this movement have been disclosed in Japanese Patent Application Laid-open 2005-87652 and others.

The integrated assembly including the hip bottom 12*b*, knee bottom 12*c* and foot bottom 12*d* will not move following the back-raising operation of the back bottom 12*a* because the hip bottom 12*b* is fixed to the top frame 10 for example. Accordingly, the flexing bottom 28 connected to the hip bottom 12*b* slides downwards over the surface of the coupling hollow 30 of the back bottom 12*a* (see FIGS. 1(*a*) and 1(*b*)). Since the conventional flexing bottom is connected to the back bottom 12*a*, the flexing bottom is required to be expandable. The flexing bottom 28 of the present embodiment can be flexed thanks to the above-described simple structure. As to expandability, since the flexing bottom is adapted to slide over the back bottom 12*a*, the flexing bottom 28 itself does not need to have an expandable mechanism, hence the structure can be simplified.

Figure 8:
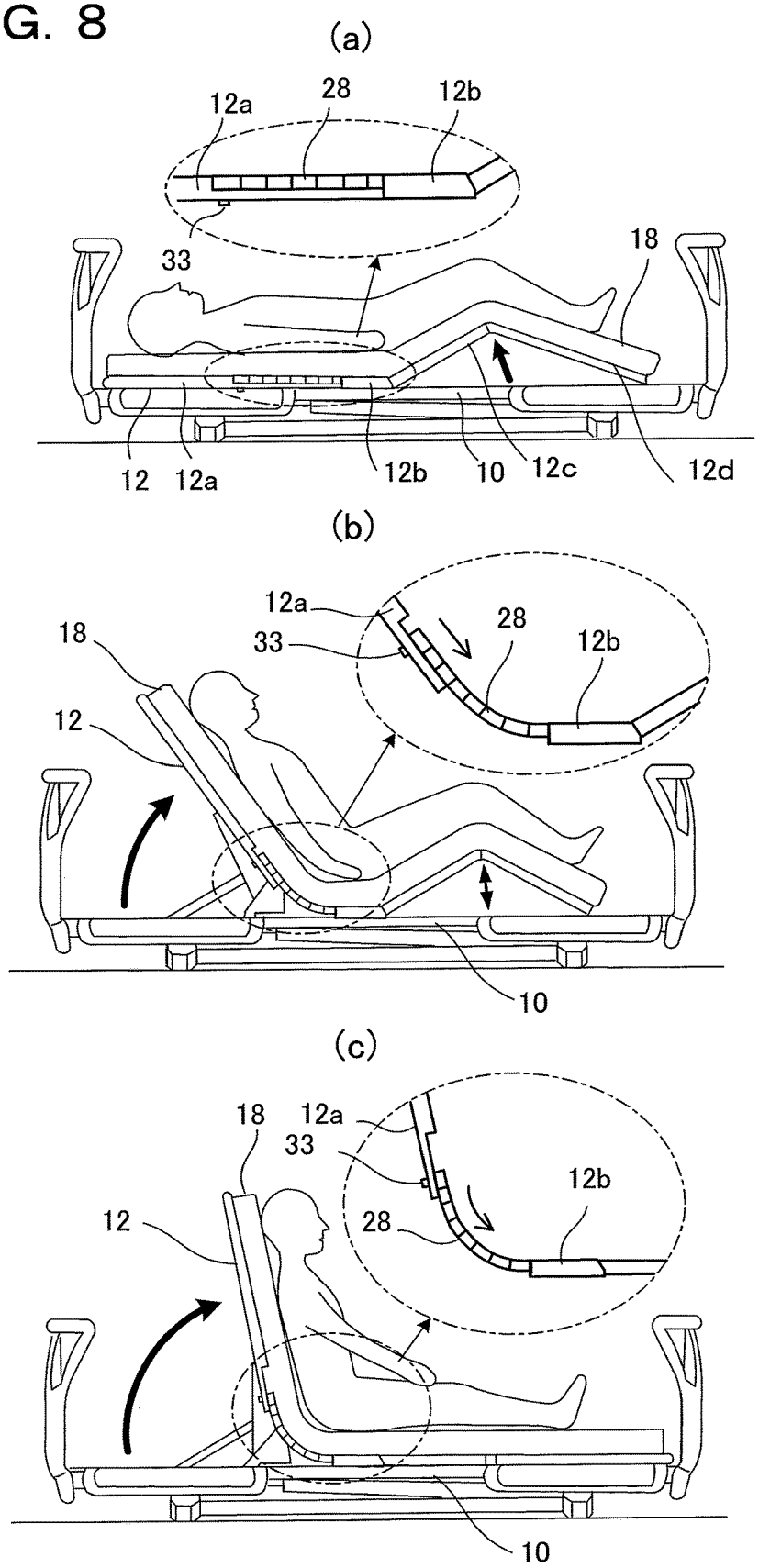
FIG. 8 An illustrative view showing bed motions in a back-raising operation.
Figure 9:
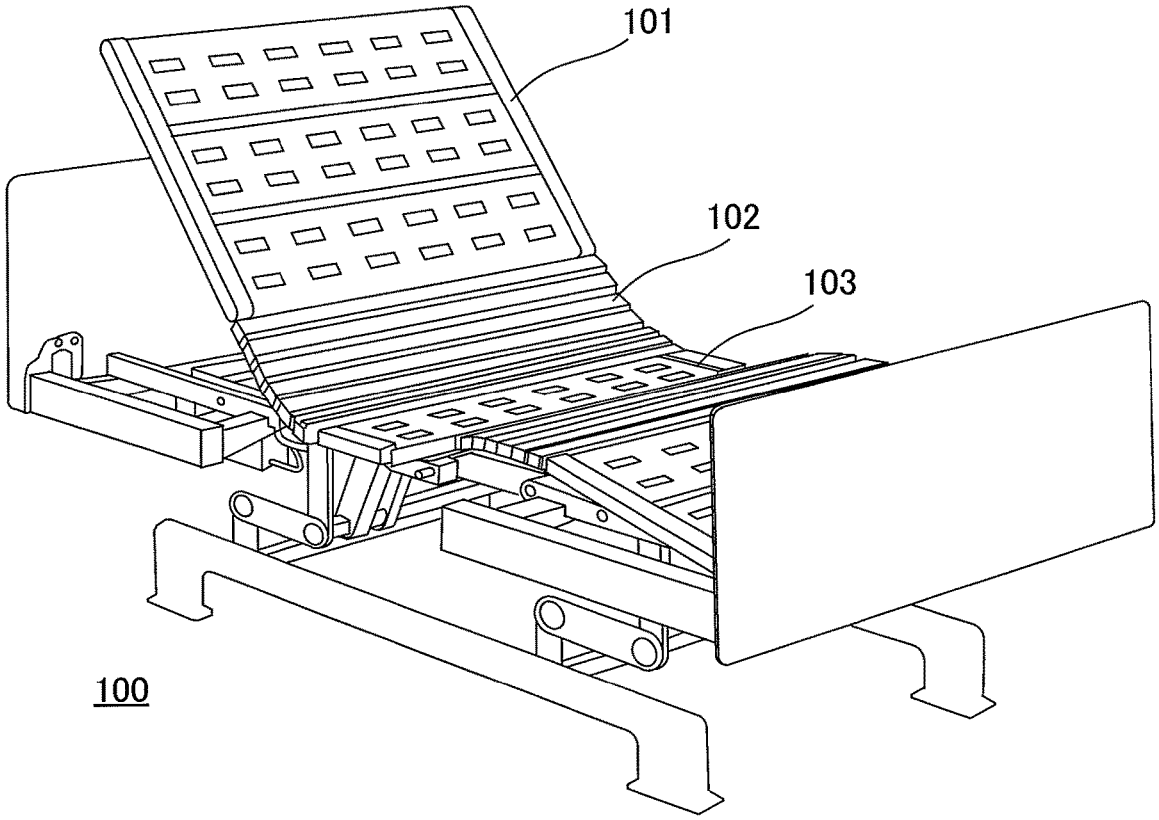
FIG. 9 An external perspective view showing one example of a conventional bed.
Figure 10:
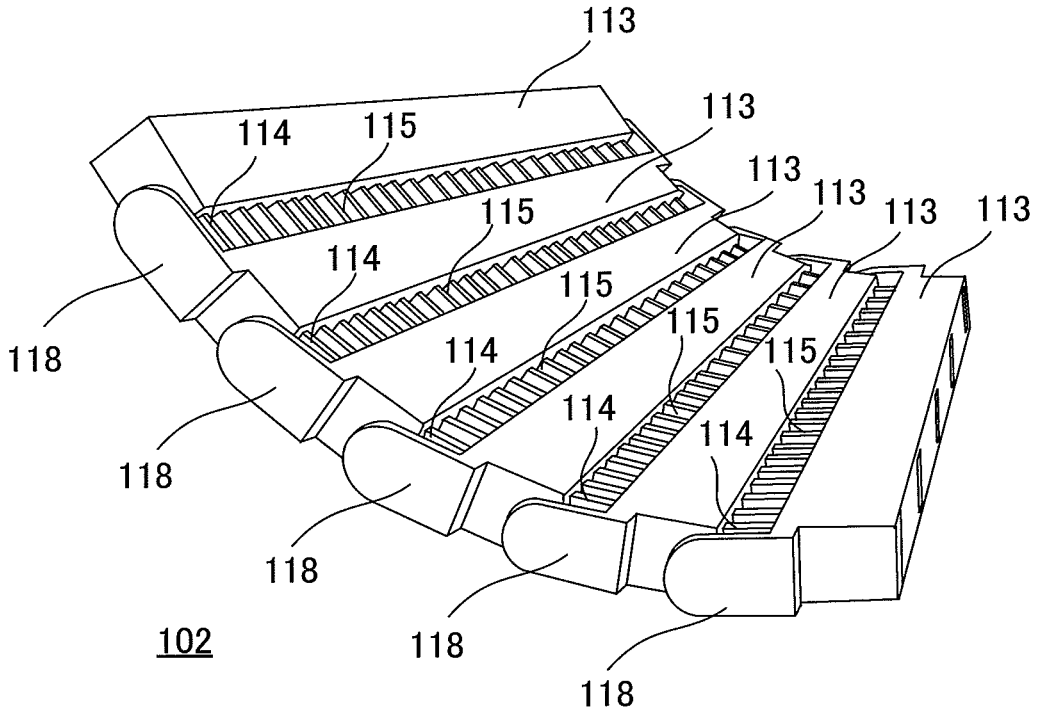
FIG. 10 An external perspective view showing a conventional flexing bottom.

FIG. 8 is an illustrative view showing bed motions in a back-raising operation.

This is one example of a back-raising operation in which the bed user's burden is alleviated as much as possible by combination with knee-raising motion.

First, in a supine position, a knee-raising operation is performed as shown in FIG. 8(*a*). The knee bottom 12*c* is raised on the foot bottom 12*d* side. During this motion, the back bottom 12*a*, flexing bottom 28 and hip bottom 12*b* will not move. In this case, the pin 33 of the flexing bottom 28 is located at the flange insert hole 30*b* as the end of slot 30*a* of the back bottom 12*a* with the flange 33*a* inserted therein (see FIGS. 6 and 3).

Then, when the knees are raised at an angle of 18°, a back-raising operation is started as shown in FIG. 8(*b*). At this point, the flexing bottom 28 begins to move down sliding over the surface of the coupling hollow 30 of the back bottom 12*a*. Since the flexing bottom 28 located between the back bottom 12*a* and the hip bottom 12*b* is flexible, it starts flexing. When the knees are raised up to 26°, the knee-raising operation is stopped while the back-raising operation is continued until the back is raised up to 40°. When the back has been raised to 40°, a knee-lowering operation is started.

As shown in FIG. 8(*c*), while the back is raised to 70° by the back-raising operation the knees are lowered to 0° by the knee-lowering operation. Thus, the back-raising operation completes. At this point, the pin 33 of the flexing bottom 28 reaches the lower end of the slot 30*a* of the back bottom 12*a*. The flexing bottom 28 is curved to the maximum between the back bottom 12*a* and the hip bottom 12*b*.

In this way, the flexing bottom 28 flexes sliding over the surface of the back bottom 12*a*, so that it is possible to avoid making the user feel pressed or uncomfortable similarly to the conventional configuration. Further, since the flexing bottom 28 is a simple bellows that itself has no expanding structure, it is possible to realize a lightweight configuration and improve transportability compared to the conventional configuration. Besides, the flexing bottom has a plate-like structure, so that ordinary people can easily perform cleaning without the need of decomposing and other labor.

Though in the embodiment, the flexing bottom 28 alone is formed in the bellows structure, the section between the knee bottom 12*c* and the foot bottom 12*d* may be made flexible using the same structure as that of the flexing bottom 28. Further, the hip bottom 12*b*, knee bottom 12*c* and foot bottom 12*d* are also formed to have the same structure as the flexing bottom 28. In this case, the bottom 12 can be rolled up and carried, contributing to improvement in transportability. Moreover, since the bottom 12 can be rolled up, it is possible to easily confirm the frame position and others by simply rolling up the bottom when the bottom is fixed at the time of assembly.

INDUSTRIAL APPLICABILITY

The bottom of the bed apparatus of the present invention can be applied to the bottoms of various kinds of bed apparatus such as in-home care nursing bed apparatus, facility care nursing bed apparatus, hospital bed apparatus and the like.

DESCRIPTION OF REFERENCE NUMERALS

10 top frame
12 bottom
12*a* back bottom
12*b* hip bottom
12*c* knee bottom
12*d* foot bottom
20 depressed portion
22 passage hole
24 connecting part
26 surrounding area
28 flexing bottom
30 coupling hollow
30*a* slot
33 pin

The invention claimed is:

1. A bottom for a bed apparatus having a back-raising mechanism, comprising:

a first bottom; and a second bottom, wherein the second bottom has a flexible flexing bottom, the flexing bottom is arranged in such a manner that the flexing bottom is overlapped and in contact with a surface of the first bottom, and in a case of a back-raising operation, as the first bottom is tilted up, the flexing bottom is increasingly bent while sliding on the surface of the uprising first bottom such that an increasing amount of a length of the flexing bottom bends.

2. The bottom for a bed apparatus according to claim 1, wherein a slot elongated in the sliding direction is provided in one of the first bottom and the flexing bottom, and a pin that moves in a state that the pin is fitted in the slot, is provided in the other of the first bottom and the flexing bottom.

3. The bottom for a bed apparatus according to claim 1, wherein the first bottom is formed with a hollow that accommodates the flexing bottom and allows the flexing bottom to slide therein.

4. The bottom for a bed apparatus according to claim 1, wherein the flexing bottom is constructed so as to be flexible by arranging a plurality of elongated bars each having a trapezoidal section and extended in a width direction of the flexing bottom, in a length direction of the flexing bottom and joining one to another with a thin part, forming an approximately bellows structure.

5. The bottom for a bed apparatus according to claim 4, further comprising a third bottom and a fourth bottom, wherein the second bottom, the third bottom and the fourth bottom are each constructed so as to be flexible by arranging another plurality of elongated bars each having another trapezoidal section and extended in a width direction of the respective second bottom, third bottom, or fourth bottom, in a length direction of the respective second bottom, third bottom, or fourth bottom and joining one to another with another thin part, forming another approximately bellows structure.

6. The bottom for a bed apparatus according to claim 1, wherein the second bottom having the flexible flexing bottom is formed as one piece.

7. The bottom for a bed apparatus according to claim 1, wherein the first bottom is formed with a hollow that accommodates the flexing bottom and allows the flexing bottom to slide therein, the flexing bottom is provided in such a manner that the flexing bottom is formed substantially flat on a surface of the first bottom and is arranged slidably in the hollow.

8. The bottom for a bed apparatus according to claim 1, wherein the first bottom is a back bottom for supporting a back, and the second bottom is a hip bottom for supporting hips.

9. The bottom for a bed apparatus according to claim 5, wherein the first bottom is a back bottom for supporting a back, the second bottom is a hip bottom for supporting hips, the third bottom is a knee bottom for supporting a knee, and the fourth bottom is a foot bottom for supporting a foot.

* * * * *